US009028271B2

(12) United States Patent
Smith

(10) Patent No.: US 9,028,271 B2
(45) Date of Patent: May 12, 2015

(54) ELECTRICAL CONNECTOR WITH INTEGRATED INDICATOR

(76) Inventor: Brian S. Smith, Arlington, TX (US)

( * ) Notice: Subject to any disclaimer, the term of this patent is extended or adjusted under 35 U.S.C. 154(b) by 0 days.

(21) Appl. No.: 13/469,000

(22) Filed: May 10, 2012

(65) Prior Publication Data

US 2014/0377982 A1 Dec. 25, 2014

Related U.S. Application Data

(60) Provisional application No. 61/484,656, filed on May 10, 2011.

(51) Int. Cl.
*H01R 13/717* (2006.01)
*H01R 13/66* (2006.01)

(52) U.S. Cl.
CPC ..... *H01R 13/7175* (2013.01); *H01R 13/6683* (2013.01)

(58) Field of Classification Search
CPC ..... H01R 13/7175; H01R 13/6683
USPC ..... 439/488–490, 188, 315, 650–655, 439/620.04, 620.22, 620.24
See application file for complete search history.

(56) References Cited

U.S. PATENT DOCUMENTS 8,029,313 B2 * 10/2011 Fendrock et al. ..... 439/489
8,371,873 B2 * 2/2013 Rizzo ..... 439/490
8,550,840 B2 * 10/2013 Mann et al. ..... 439/489

* cited by examiner

*Primary Examiner* — Edwin A. Leon
(74) *Attorney, Agent, or Firm* — J. Oliver Williams

(57) ABSTRACT

The present invention is a diagnostic, intermediate connector for electrically coupling a first external apparatus having a male Deutsch connector and a second external apparatus having a female Deutsch connector. The diagnostic connector includes a male and female plug assemblies having electrical inlets, embedded circuit with LEDs, and having a portion generally shaped as Deutsch connector. Light emitting diodes visually indicate a complete circuit with coupled external apparatus.

11 Claims, 9 Drawing Sheets

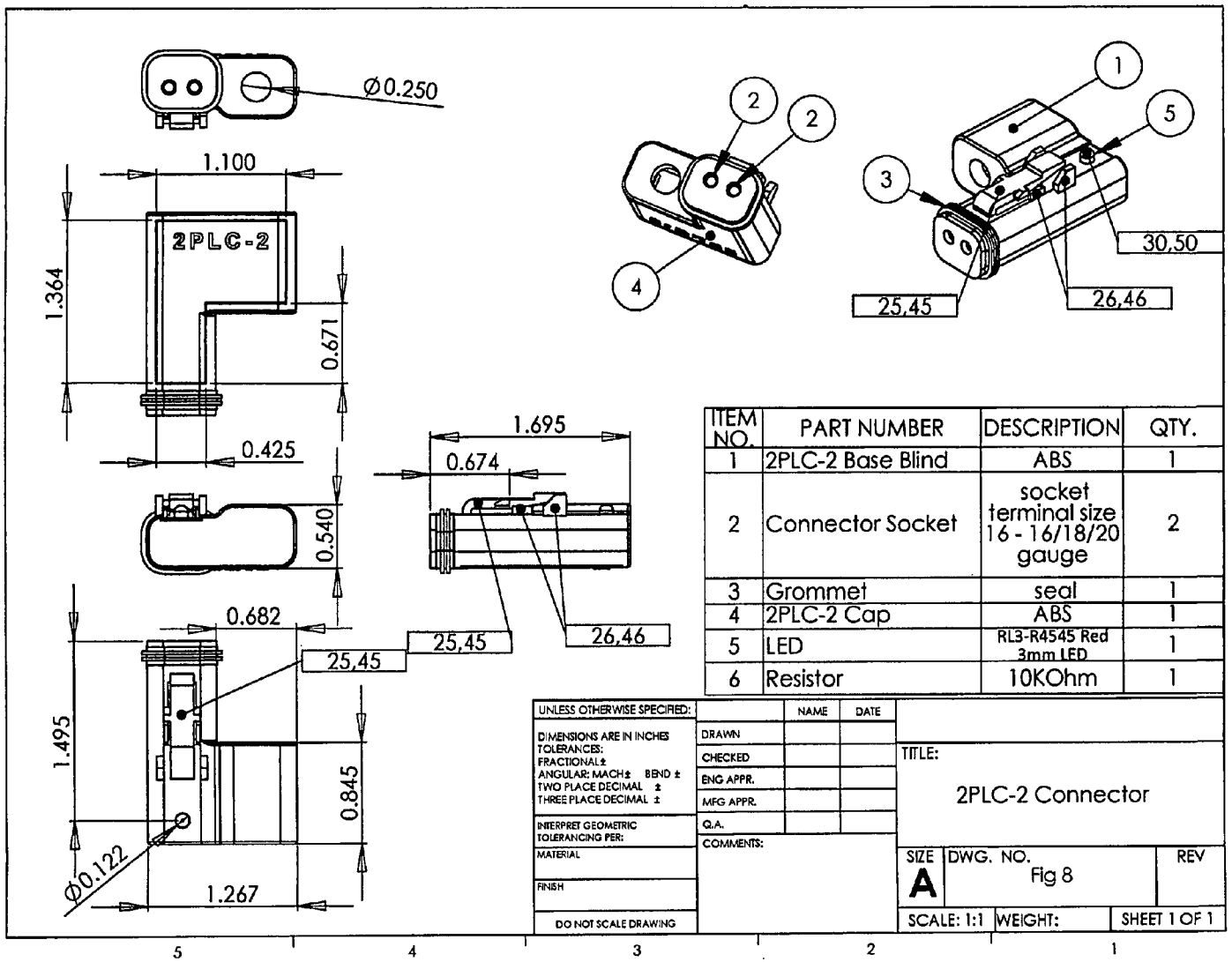
ITEM NO.
PART NUMBER
DESCRIPTION
QTY.
1
2PLC-2 Base Blind
ABS
1
2
Connector Socket
socket terminal size 16 - 16/18/20 gauge
2
3
Grommet
seal
1
4
2PLC-2 Cap
ABS
1
5
LED
RL3-R4545 Red 3mm LED
1
6
Resistor
10KOhm
1
TITLE:
2PLC-2 Connector
SIZE
A
DWG. NO.
Fig 8
REV
SCALE: 1:1
WEIGHT:
SHEET 1 OF 1
DRAWN
CHECKED
ENG APPR.
MFG APPR.
Q.A.
COMMENTS:
NAME
DATE
UNLESS OTHERWISE SPECIFIED:
DIMENSIONS ARE IN INCHES
TOLERANCES:
FRACTIONAL ±
ANGULAR: MACH ± BEND ±
TWO PLACE DECIMAL ±
THREE PLACE DECIMAL ±
INTERPRET GEOMETRIC TOLERANCING PER:
MATERIAL
FINISH
DO NOT SCALE DRAWING
30.50
26.46
25.45
Ø0.250
1.100
0.671
0.425
0.540
1.364
1.695
0.674
0.682
0.845
1.267
1.495
Ø0.122
2PLC-2

ELECTRICAL CONNECTOR WITH INTEGRATED INDICATOR

PRIORITY

The present invention claims priority to provisional application 61/484,656, which has a filing date of May 10, 2011 and is hereby incorporated by reference.

BACKGROUND

1. Field of the Invention

The present invention relates to a device for electrical connection and testing, more specifically to a device for indicating electrical communication between two external apparatus.

2. Description of the Related Art

In an industrial environment, it is frequently necessary to electrically couple a pair of devices. In a common scenario, a directional control device may be coupled to industrial or mobile machinery. In such an environment, the apparatus may be stored, used, and operated in harsh environments. The electrical components within the apparatus may be subjected high voltage, high amperage, rapid signal changes, or other high specification electrical demands, which may decrease the life span of the components. Moreover, the physical aspects of electrical connections, such as the contacts, joints, sockets, cables, and the like, may experience repetitive stress and rough physical treatment, or environmental contaminants such as dirt, dust, or moisture, inhibiting the electrical communication with the device. In the industrial environment, it is desirable to couple the electrical devices, start the operation, and continue operation with minimal downtime. In the case of malfunctions it may be feasible to detect and swap the malfunctioning device instead of diagnosing the malfunctioning device at the component level. Current cabling with Deutsch style two-way connectors lacks the ability to readily display whether the paired devices are electrically coupled. The operator may need to resort to baring wires, tracing wire harnesses, probe testing, using multimeters, or similar burdensome steps. Those actions may not be possible in some environment or might put the user at risk. For that reason, it would be advantageous to have a device which couple Deutsch style two-way connector ready devices which also readily indicates that the devices are in electrical communication.

SUMMARY

The present invention is a diagnostic, intermediate connector for electrically coupling a first external apparatus having a male two pin Deutsch connector and a second external apparatus having a female two pin Deutsch connector. The diagnostic connector comprises a first plug assembly having two electrical inlets, a first embedded circuit, and having a portion generally shaped as a female two pin Deutsch connector. A first resistor is in series with a first light emitting diode disposed in a first parallel branch of the first embedded circuit, with the first light emitting diode operable to visually indicate a complete circuit with a coupled first external apparatus.

The first plug assembly is in electrical communication with a second plug assembly. The second plug assembly includes two electrical inlets, a second embedded circuit, and a portion generally shaped as a male two pin Deutsch connector. It further includes a second resistor in series with a second light emitting diode disposed in a first parallel branch of said second embedded circuit, the second light emitting diode operable to visually indicate a complete circuit with a coupled second external apparatus.

These and other features, aspects, and advantages of the invention will become better understood with reference to the following description, and accompanying drawings.

BRIEF DESCRIPTION OF THE DRAWINGS

FIG. 8 depicts a schematic of the embodiment of FIG. 1; and

DETAILED DESCRIPTION

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure, or manner.

Figure 1:
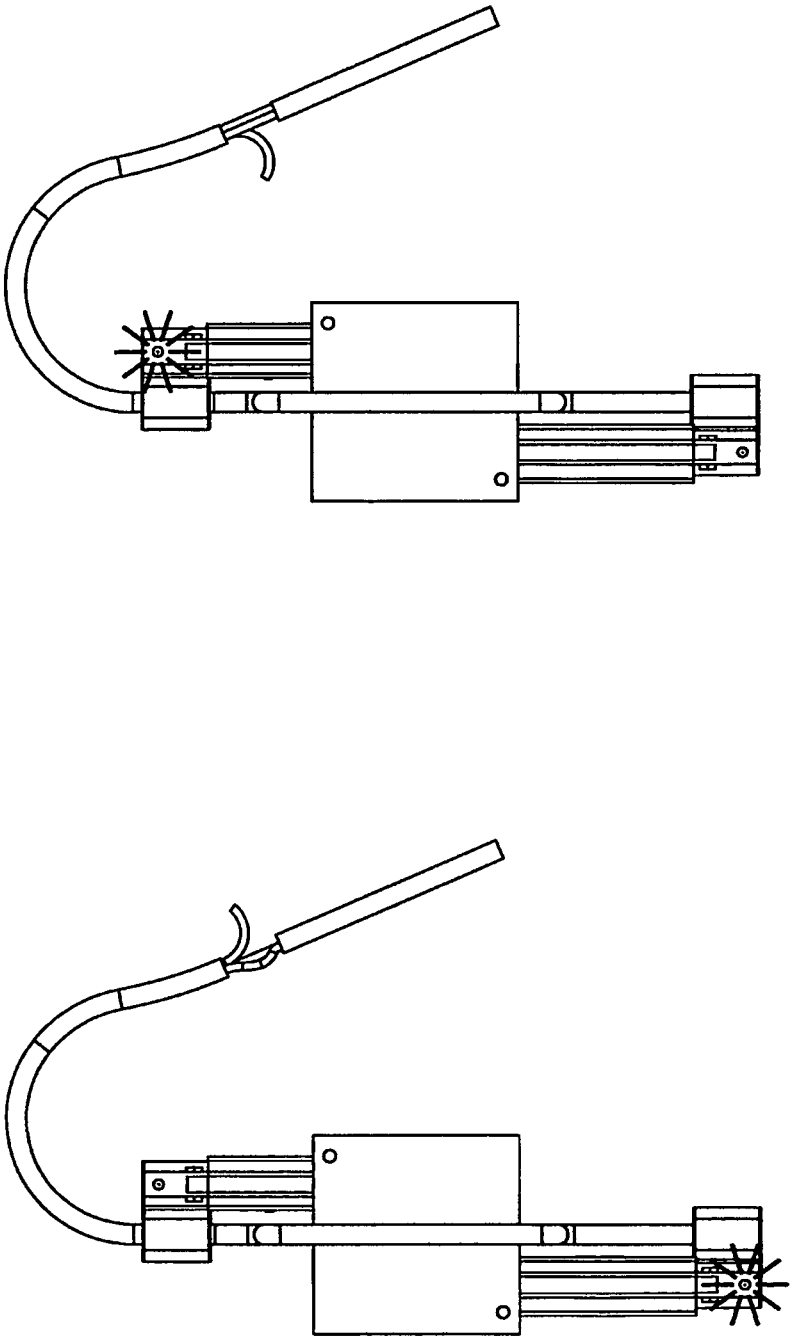
FIG. 1 depicts an embodiment of the current invention coupled to an external apparatus, where the plug assemblies are in different states.
Figure 2:
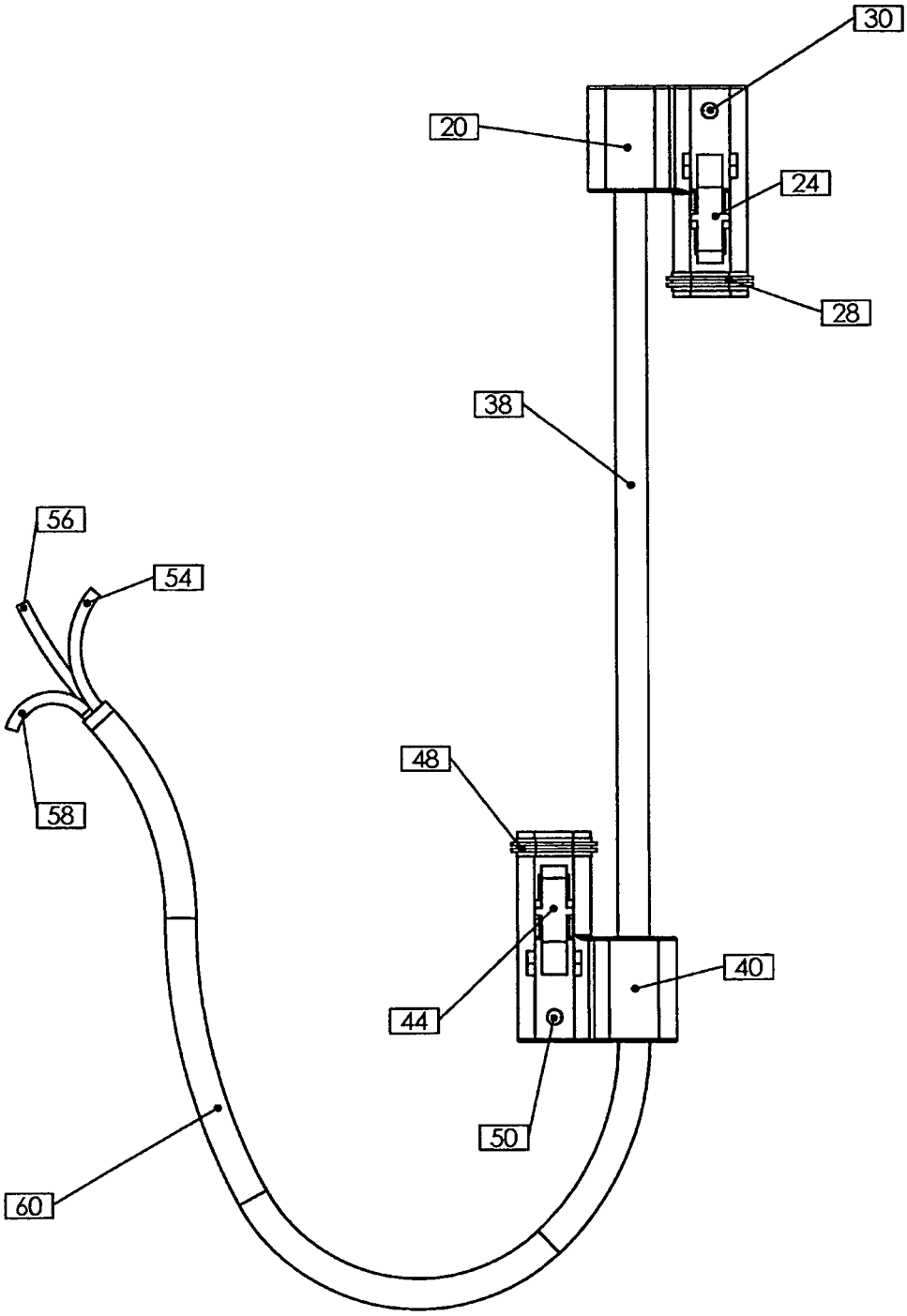
FIG. 2 depicts the embodiment of FIG. 1 in isolation.

The electrical connector 10 is a device for electrically, communicatively coupling two external apparatus having Deutsch style two-way connectors and visually indicating the status of that electrical connection. FIG. 2 illustrates an embodiment of the system of the present invention. Depicted are a plurality of wires, a lead cable 60, a first plug assembly 40, a second length of cable 38, and a second plug assembly 20.

A lead cable 60 houses three insulated wires 54 56 58. Wires 56 58 are positive or "hot," while wire 54 provides a common negative wire. The lead cable 60 housing the wires 54 56 58 enters a first end of a plug assembly 40 body through a cable inlet.

The first plug assembly 40 includes a body 21 having a cable inlet, a cable outlet, a void interior region, a connector region 44, and a visual indicator 50. The body is preferably further comprised of joined opposing members 22 23.

The connector region 44 is generally shaped as the male plug portion of a Deutsch style 2-way connector pair, that is a Deutsch style connector having two electrical channels. The connector region 44 is adapted for mating with an external apparatus having the corresponding receptacle of the Deustch style 2-way connector pair.

Figure 6:
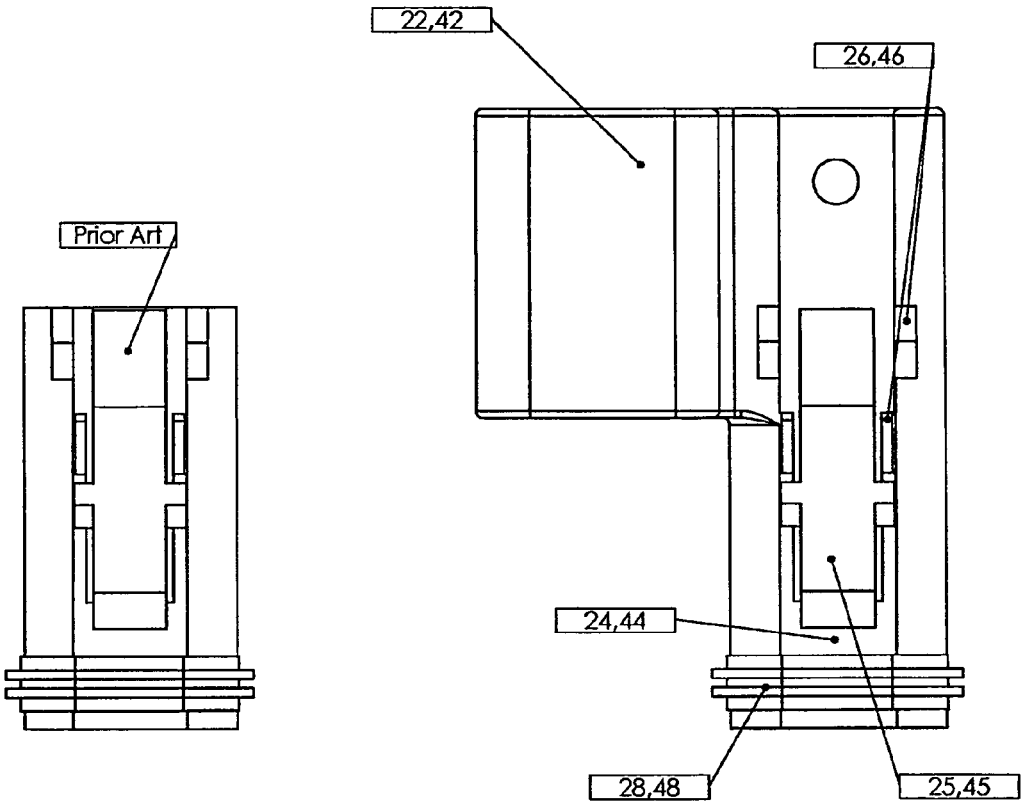
FIG. 6 depicts the major elements of the exterior surfaces of the prior art receptacles and the receptacles of FIG. 1.
Figure 7:
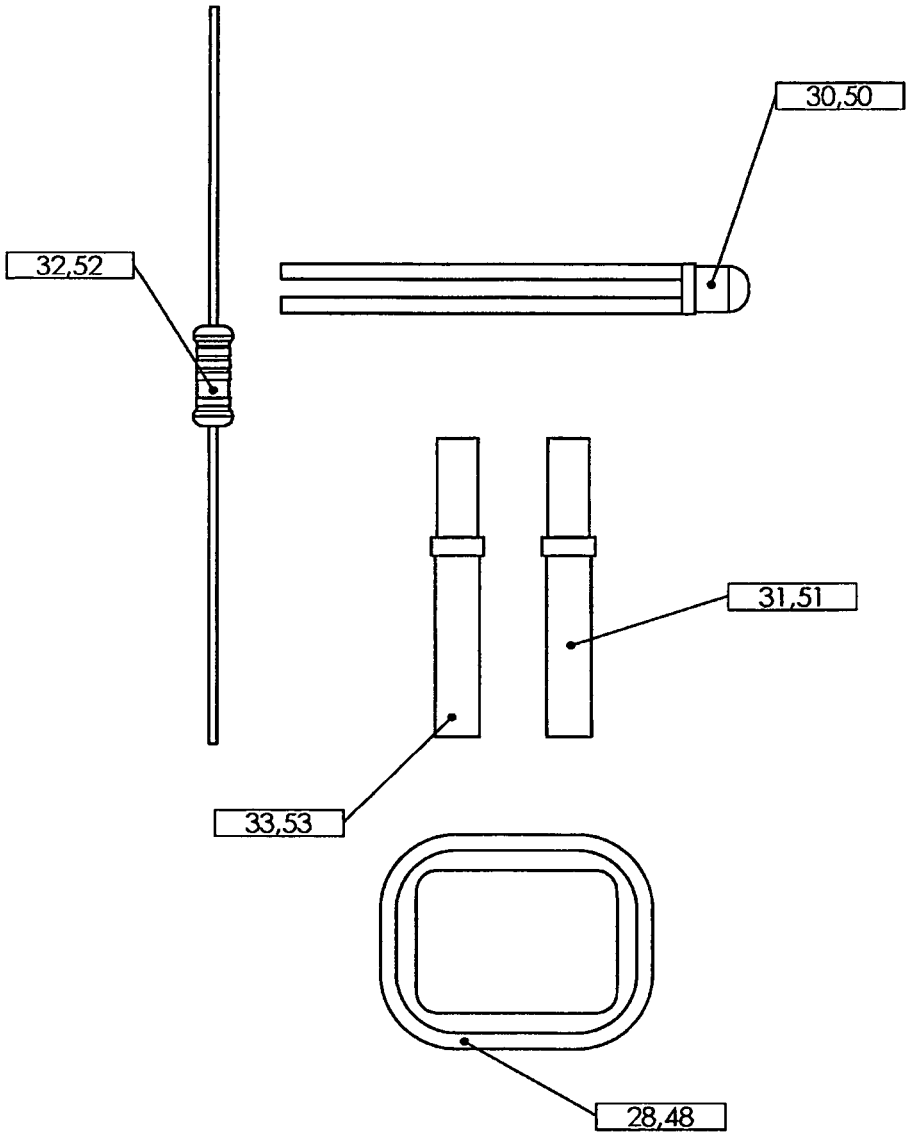
FIG. 7 depicts the major electrical components of a plug assembly of FIG. 1.

The connector region 44 has a generally rectangular cross-sectional profile with a front face having two adjacent apertures spaced about 0.425 inches apart, consistent with the Deutsch 2-way connector specifications. FIG. 6 shows the exterior of the first plug assembly 40, which includes sections to support a secure connection to a corresponding female Deutsch connector. Depicted in this embodiment are a seal 48, a finger 45, and a plurality of ridges 46. Surrounding the front face and a portion of the connector region 44 is a seal 48 extending distally from the front face. A flexible finger 45 is also fixed at a base to the connector region 44 extending distally and upwardly. The distal region of the finger is biased upward from the surface of the connector region 44. Along the edges of the finger 45 are ridges 46 rising upwardly from the surface of the connector region 44 configured to guide the corresponding female Deutsch connector during pairing and maintain the secure connection after the pairing.

Figure 4:
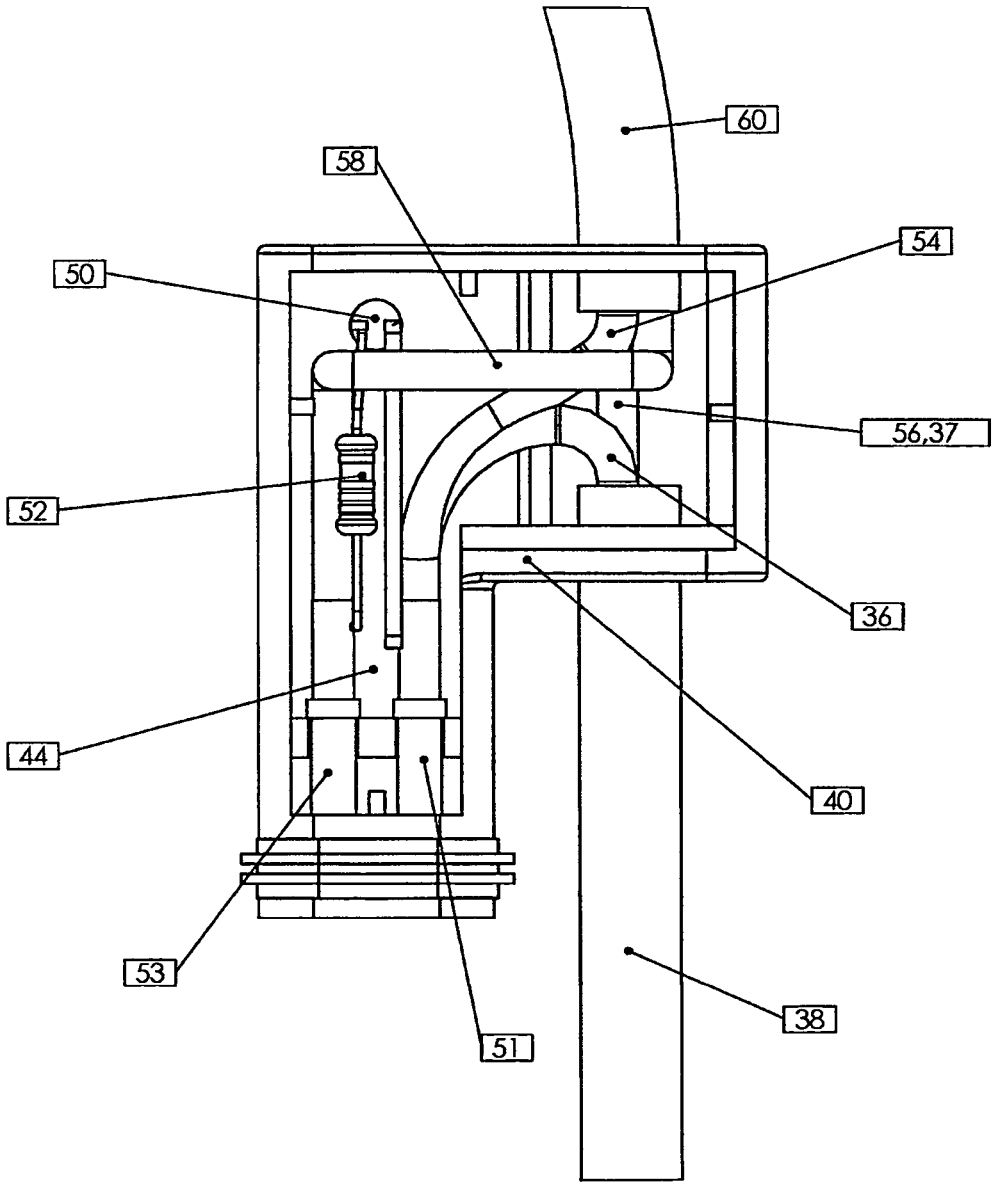
FIG. 4 depicts a cutaway view of the second plug assembly of FIG. 1.
Figure 5:
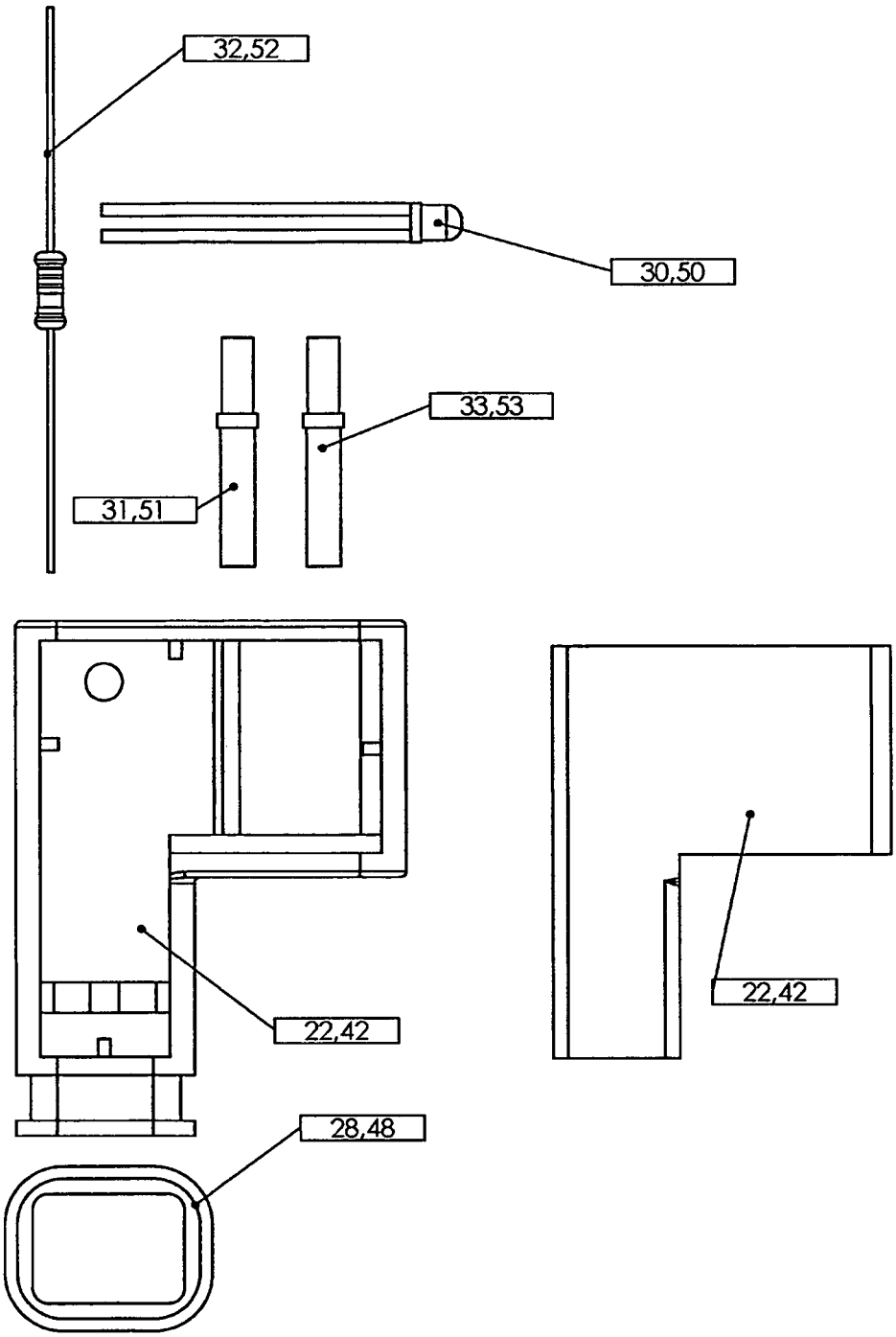
FIG. 5 depicts the major components of the interior of the first plug assembly of FIG. 3.
Figure 9:
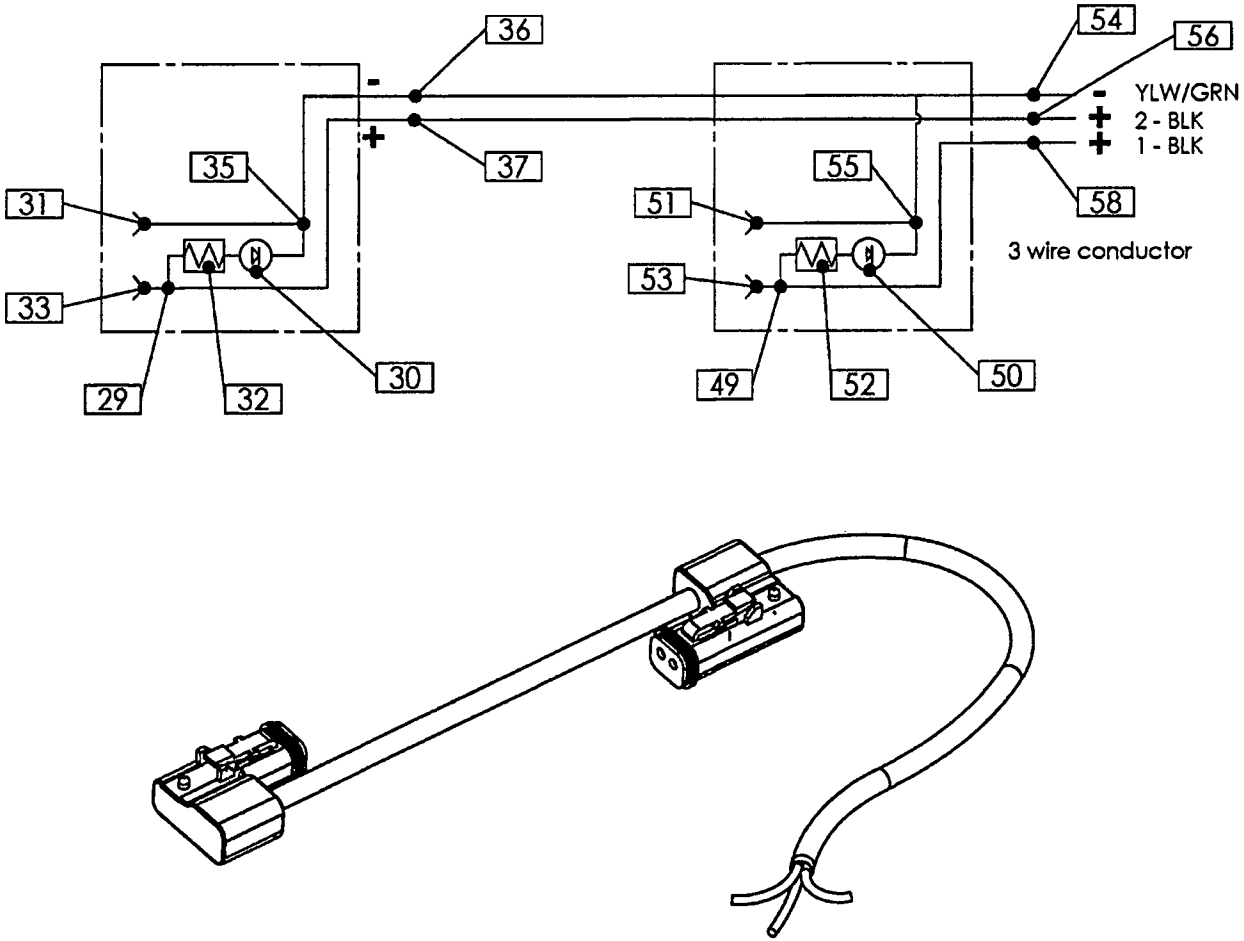
FIG. 9 depicts a representative circuit diagram of the embodiment of FIG. 1.

The void interior of the first plug assembly 40 includes a circuit to receive and process signals from the external apparatus as well as electrically communicate with the second plug assembly 20. FIG. 5 depicts the major electrical elements of the circuit, namely, two sockets 51 53, a resistor 52, and a light emitting diode (LED) 50. 45 The two sockets 51 53 are joined with the apertures on the front face of the connector region 44 where the sockets may receive and maintain electrical communication with a pin inserted therein. The LED 50 head is mounted such that it can be seen from the exterior of the plug assembly 40. FIG. 4 depicts a cutaway view of that circuit. FIG. 9 depicts the circuit diagram. The lead cable 60 containing the wire 54 56 58 enters the interior through the cable inlet. The hot wire 58 leads to two parallel branches. After a first junction 49, a first branch is coupled to a first socket 53 enabling electrical communication with a pin inserted thereto. A second branch has an LED 50 in series with a resistor 52. The resistor 52 and LED 50 values are selected in combination in order for the LED 50 to emit light under desired signal conditions. The resistor's 52 value is determined based on the attached external apparatus and the LED 50. The LED 50 can also be altered based upon the external apparatus' circuit and desired visual properties. For example, the LED's 50 rating may vary according to the need to visually indicate the relative current. At 12 or 24 volts DC applied from wire 54, the circuit preferably employs a 10 kiloohm resistor and a 20 milliamp rated LED. This second branch terminates at a second junction 55. Also coupled to the second junction 55 is a second socket 51 enabling electrical communication with a pin inserted thereto. The second junction 55 terminates at common, negative wire 54.

The remainder of the void interior of the body 21 is potted, preferably using a two part potting epoxy system.

Coupled from negative wire 54 is a wire 36 exiting the first plug assembly 40. Coupled from hot wire 56 is another wire 37, also exiting the first plug assembly 40. A secondary cable 38 encompasses the exiting wires 36 37. The secondary cable 38 extends to and is in electrical communication with the second plug assembly 20.

The second plug assembly 20 is configured similarly to that of the first plug assembly 40. The second plug assembly 40 includes a body having a cable inlet, a void interior region, a connector region 24, and an visual indicator 30. The body 41 is preferably further comprised of opposing members 42 43.

The connector region 24 is preferably generally shaped as the male plug portion of a Deutsch style 2-way connector pair. The connector region 24 is adapted for mating with an external apparatus having the corresponding receptacle of the Deutsch style 2-way connector pair.

The connector region 24 has a generally rectangular cross-sectional profile with a front face having two adjacent apertures spaced apart about 0.425 inches. FIG. 6 shows the exterior of the second plug assembly 20, which includes sections to support a secure connection to a corresponding female Deutsch connector. Depicted in this embodiment are a seal 28, a finger 25, and a plurality of ridges 26. Surrounding the front face and a portion of the connector region 24 is a seal 28 extending distally from the front face. A flexible finger 25 is also fixed at a base to the connector region 24 extending distally and upwardly. The distal region of the finger 25 is biased upward from the surface of the connector region 24. Along the edges of the finger 25 are ridges 26 rising upwardly from the surface of the connector region 44 configured to guide the corresponding female Deutsch connector during pairing and maintain the secure connection after the pairing.

Figure 3:
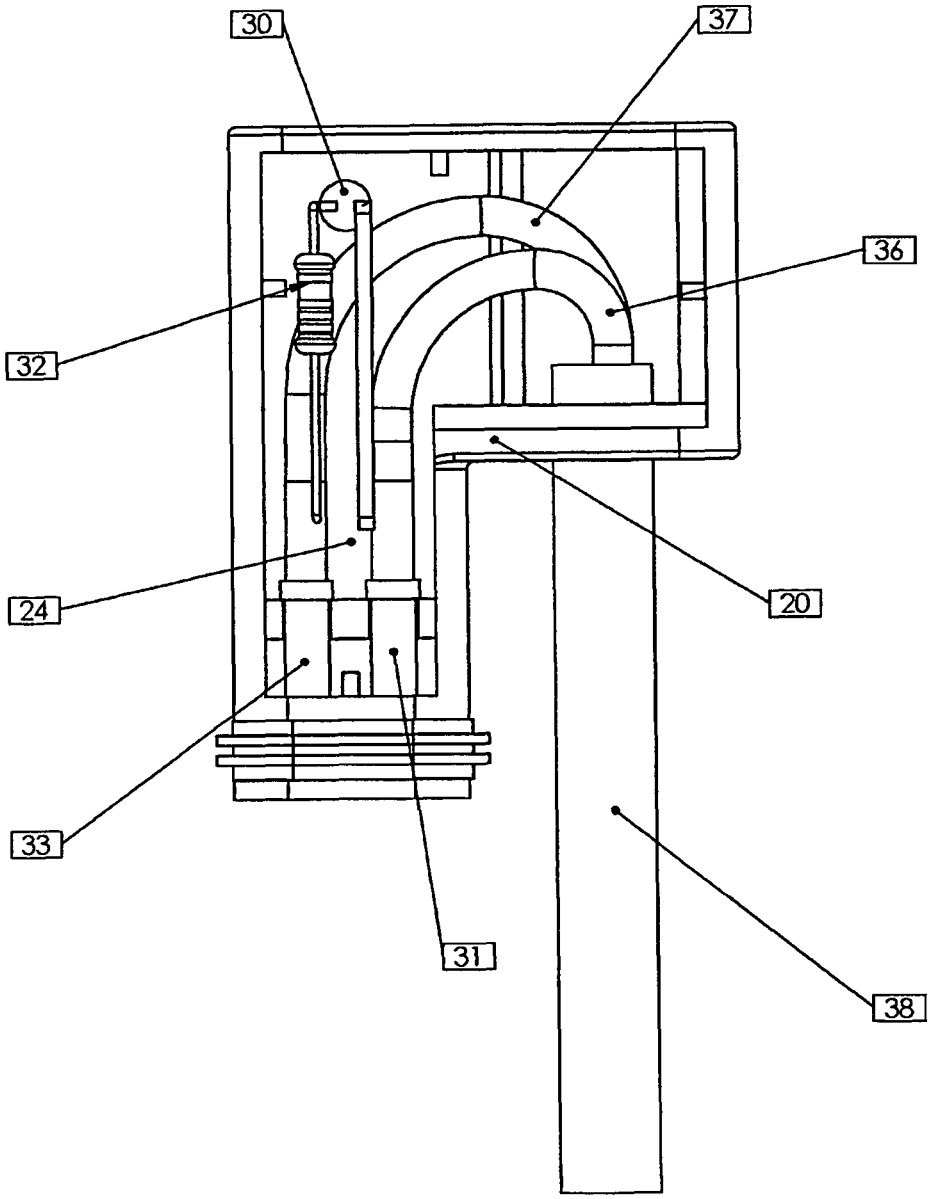
FIG. 3 depicts a cutaway view of the first plug assembly of FIG. 1.

The void interior of the second plug assembly 20 includes a circuit to receive and process signals from the external apparatus as well as electrically communicate with the first plug assembly 40. FIG. 5 depicts the major electrical elements of the circuit, namely, two sockets 31 33, a resistor 32, and a light emitting diode (LED) 30. The two sockets 31 33 are joined with the apertures on the front face of the connector region 24 such that the sockets may receive and maintain electrical communication with a pin inserted therein. The LED 50 head is mounted such that it can be seen from the exterior of the plug assembly 20. FIG. 3 depicts a cutaway view of that circuit. FIG. 9 depicts the circuit diagram. The secondary cable 38 containing the wire 36 37 enters the interior through the cable inlet. The hot wire 37 leads to two parallel branches. After a first junction 29, a first branch is coupled to a first socket 33 enabling electrical communication with a pin inserted therein. A second branch has an LED 30 in series with a resistor 32. The resistor 32 and LED 30 values are selected in combination in order for the LED 30 to emit light under desired signal conditions. The resistor's value is determined based on the attached external apparatus and the LED 30. The LED 30 can also be altered based upon the external apparatus and desired visual properties. For example, the LED's 30 rating may vary according to the need to visually indicate the relative current. At 12 or 24 volts DC applied from wire 54, the circuit preferably employs a 10 kiloohm resistor and a 20 milliamp rated LED. This second branch terminates at a second junction 35. Also coupled to the second junction is a second socket 31 enabling electrical communication with a pin inserted therein. The second junction 35 terminates at wire 36.

The remainder of the void interior of the body 41 is potted, preferably using a two part potting epoxy system.

The complete circuit is represented by that of FIG. 9 as well as the coupled circuit of the attached external apparatus. To use the electrical connector 10 of the current invention, an external apparatus is mated to each of the plug assemblies 20 40, engaging the receptacle of the external apparatus to the plug assembly 20 40 such that the finger 25 45 and the ridges 26 46 lock into the interior of the mated receptacle. Power is provided to the circuit at wires 56 58. LED 30 is observed to determined whether the attached external apparatus is functioning and in electrical communication. LED 50 is observed to determined whether the external apparatus is functioning and in electrical communication. When either LED fails to activate, the complete circuit is not in electrical communication.

Insofar as the description above and the accompanying drawing disclose any additional subject matter that is not within the scope of the single claim below, the inventions are not dedicated to the public and the right to file one or more applications to claim such additional inventions is reserved.

What is claimed is:

1. A diagnostic, intermediate connector for electrically coupling a first external apparatus having a male two pin Deutsch connector and a second external apparatus having a female two pin Deutsch connector, said diagnostic connector comprising:

a first plug assembly having two electrical inlets, a first embedded circuit, and having a portion shaped as a female two pin Deutsch connector;

a first resistor in series with a first light emitting diode disposed in a first parallel branch of said first embedded circuit, said first light emitting diode operable to visually indicate a complete circuit with a coupled first external apparatus;

said first plug assembly is in electrical communication with a second plug assembly;

said second plug assembly having two electrical inlets, a second embedded circuit, and having a portion shaped as a male two pin Deutsch connector; and a second resistor in series with a second light emitting diode disposed in a first parallel branch of said second embedded circuit, said second light emitting diode operable to visually indicate a complete circuit with a coupled second external apparatus.

2. The device of claim 1 wherein said first light emitting diode is multicolor.

3. The device of claim 1 wherein said second light emitting diode is multicolor.

4. The device of claim 1 further comprising a power source.

5. The device of claim 4 wherein said power source is about twelve to twenty-four volts.

6. The device of claim 5 wherein said first resistor is about ten kilohms.

7. The device of claim 5 wherein said second resistor is about ten kilohms.

8. The device of claim 1 further comprising a seal proximate the front face of said first plug assembly, said seal encompassing a portion of the exterior surface.

9. The device of claim 1 further comprising a seal proximate the front face of said second plug assembly, said seal encompassing a portion of the exterior surface.

10. The device of claim 1 wherein said first plug assembly further comprises a finger and ridges.

11. The device of claim 1 wherein said second plug assembly further comprises a finger and ridges.

* * * * *